US006491103B2

(12) United States Patent
Allamon et al.

(10) Patent No.: US 6,491,103 B2
(45) Date of Patent: Dec. 10, 2002

(54) SYSTEM FOR RUNNING TUBULAR MEMBERS

(75) Inventors: Jerry P. Allamon, 34 Naples La., Montgomery, TX (US) 77356; Kenneth David Waggener, Houston, TX (US)

(73) Assignees: Jerry P. Allamon, Montgomery, TX (US); Shirley C. Allamon, Montgomery, TX (US)

( * ) Notice: Subject to any disclaimer, the term of this patent is extended or adjusted under 35 U.S.C. 154(b) by 9 days.

(21) Appl. No.: 09/829,107

(22) Filed: Apr. 9, 2001

(65) Prior Publication Data

US 2002/0144813 A1 Oct. 10, 2002

(51) Int. Cl.[7] ..... E21B 34/06

(52) U.S. Cl. ..... 166/318; 166/169; 166/177.3; 166/193; 166/327

(58) Field of Search ..... 166/376, 386, 166/291, 317, 318, 327, 177.3, 177.4, 155, 154, 193, 169

(56) References Cited

U.S. PATENT DOCUMENTS

| | | | | |
|---|---|---|---|---|
| 2,196,652 A | 4/1940 | Baker | 166/1 |
| 2,737,244 A | 3/1956 | Baker et al. | 166/124 |
| 2,947,363 A | 8/1960 | Sackett et al. | 166/224 |
| 3,039,531 A | 6/1962 | Scott | 166/70 |
| 3,053,322 A | 9/1962 | Kline | 166/184 |
| 3,118,502 A | 1/1964 | Cochran | 166/129 |
| 3,148,731 A | 9/1964 | Holden | 166/184 |
| 3,376,935 A | 4/1968 | Baker et al. | 166/224 |
| 3,403,729 A | 10/1968 | Hickey | 166/75 |
| 3,713,490 A | 1/1973 | Watson | 166/305 |
| 3,730,267 A | 5/1973 | Scott | 166/0.5 |
| 3,955,624 A | 5/1976 | Fredd et al. | 166/72 |
| 4,033,408 A | 7/1977 | Fredd et al. | 166/75 R |
| 4,064,937 A | 12/1977 | Barrington | 166/162 |
| 4,103,503 A | 8/1978 | Smith | 61/97 |
| 4,132,243 A | 1/1979 | Kuus | 137/268 |
| 4,252,196 A | 2/1981 | Silberman et al. | 166/318 |

(List continued on next page.)

FOREIGN PATENT DOCUMENTS

| | | | |
|---|---|---|---|
| GB | WO88/01678 | 10/1988 | E21B/33/16 |

OTHER PUBLICATIONS

Brown Oil Tools, Inc. General Catalog, 1962–1963, front cover and p. 887, 2 pps.

Brown Oil Tools, Inc. General Catalog, 1966–1967, front and rear covers and pp. 906–955, in particular, see p. 948 for "Combination Plug Dropping Head and Swivel", Brown Circulating Valve, "Centrury Set Shoes Types T, V&K" and "Orifice Float Collar," 52 pps.

(List continued on next page.)

*Primary Examiner*—David Bagnell
*Assistant Examiner*—Zakiya Walker
(74) *Attorney, Agent, or Firm*—Jackson Walker; Clarence E. Eriksen

(57) ABSTRACT

The present invention relates to a wiper plug and internal drop ball mechanism that may be used in conjunction with a downhole surge reduction tool to run, hang, and cement casing liners in a wellbore. The apparatus of the present invention comprises a wiper plug assembly removably attached to the drill string within the casing liner, a drop ball sub attached below the wiper plug assembly which releases a float valve actuator ball having a diameter larger than the drill string, and float equipment having a plurality of flapper valves. The apparatus of the present invention may further comprise a diverter tool connected between the drill string and the casing liner.

11 Claims, 14 Drawing Sheets

U.S. PATENT DOCUMENTS

| | | | | | |
|---|---|---|---|---|---|
| 4,427,065 | A | | 1/1984 | Watson | 166/250 |
| 4,435,872 | A | | 3/1984 | Leikam | 15/104.06 A |
| 4,580,632 | A | | 4/1986 | Reardon | 166/250 |
| 4,589,495 | A | * | 5/1986 | Langer et al. | 166/383 |
| 4,671,353 | A | | 6/1987 | Daming | 166/70 |
| 4,893,678 | A | | 1/1990 | Stokley et al. | 166/374 |
| 4,916,999 | A | | 4/1990 | Palmer et al. | 89/1.815 |
| 4,934,452 | A | | 6/1990 | Bradley | 166/153 |
| 5,018,579 | A | | 5/1991 | Braddick et al. | 166/291 |
| 5,181,569 | A | | 1/1993 | McCoy et al. | 166/317 |
| 5,244,044 | A | | 9/1993 | Henderson | 166/332 |
| 5,277,248 | A | | 1/1994 | Breland | 166/70 |
| 5,290,128 | A | | 3/1994 | Yeargain et al. | 405/209 |
| 5,388,930 | A | | 2/1995 | McNease | 405/209 |
| 5,413,172 | A | | 5/1995 | Laurel | 166/153 |
| 5,419,657 | A | | 5/1995 | Davis | 405/209 |
| 5,421,408 | A | | 6/1995 | Stoisits et al. | 166/274 |
| 5,443,122 | A | | 8/1995 | Brisco | 166/285 |
| 5,499,687 | A | | 3/1996 | Lee | 175/317 |
| 5,553,667 | A | | 9/1996 | Budde et al. | 166/70 |
| 5,641,021 | A | | 6/1997 | Murray et al. | 166/291 |
| 5,722,491 | A | | 3/1998 | Sullaway et al. | 166/291 |
| 5,960,881 | A | | 10/1999 | Allamon et al. | 166/291 |
| 6,082,451 | A | | 7/2000 | Giroux et al. | 166/72 |
| 6,311,775 | B1 | * | 11/2001 | Allamon et al. | 166/285 |
| 6,401,822 | B1 | * | 6/2002 | Baugh | 166/319 |

OTHER PUBLICATIONS

Brown Oil Tools, Inc. General Catalog, 1970–1971, front and rear covers and pp. 806–875, in particular, see pp. 852 for "Type C–1 "J" Setting Tool," "Type CS Setting Tool," "Heavy Duty Dropping Heat," and "Combination Plug Dropping Head and Swivel" and p. 854 for "Circulating Valve" and "Cementing Set Shoes, Type T, V, K&K Modified," 72 pps.

Brown Oil Tools, Inc. General Catalog, 1972–1973, front and rear covers and pp. 714–784, in particular, see pp. 762 and 763, 72 pps.

Brown Oil Tools, Inc. General Catalog, 1974–1975, front and rear covers and pp. 746–816, in particular, see pp. 792–793, 72 pps.

Brown Oil Toos, Inc. General Catalog, 1976–1977, front and rear covers and pp. 857–904, in particular, see pp. 900 and 902, 50 pps.

Brown Oil Tools, Inc. General Catalog, 1982–1983, front cover and pp. 1410–1440, 32 pps.

Brown Oil Tools, Inc. General Catalog, 1986–1987, front cover and pp. 3052–3072, in particular see, pp. 3070–3071, 22 pps.

Baker Oil Tools, Inc. Catalog, 1962, front cover and pp. 461–466, 7 pps.

Baker Oil Tools, Inc. Catalog, 1966–67, front cover and pp. 502–504, 5 pps.

Baker Oil Tools, Inc. Catalog, 1970–71, front cover and pp. 580–596, 19 pps.

Baker Oil Tools, Inc. Catalog, 1972–73, front cover and pp. 356–376, 22 pps.

Baker Oil Tools, Inc. Catalog, 1974–75, front cover and pp. 324–348, 26 pps.

Baker Oil Tools, Inc. Catalog, 1976–77, front cover and pp. 396–418, 25 pps.

Baker Oil Tools, Inc. Catalog, 1982–83, front cover and pp. 662–680, 22 pps.

Baker Oil Tools, Inc. Product Guide, 1986–87, pp. 321, 336–337, 3 pps.

Baker Service Tools Mini Catalog, 1986–87, pp. 373–374, 2 pps.

Baker Oil Tools—Retrievable Packer Systems—Model "E"™ Hydro–Trip Pressure Sub Product No. 799–28, Specification Guide, pp. 53, 1 pp. (undated).

Lindsey Completion Systems General Gatalog, 1986–87, frong cover and rear cover and pp. 4246–4275, in particular, pp. 4260 re "Cementing Equipment—Manifold", 32 pps.

Texas Iron Works Catalog 1962–63, front cover and pp. 4902–4903, 3 pps.

Texas Iron Works Catalog, 1966–67, front cover and pp. 4802–4803, 3 pps.

Texas Iron Works, Catalog, 1970–71, front cover and pp. 4612, 2 pps.

Texas Iron Works Catalog, 1972–73, front cover and pp. 4430, 2 pps.

Texas Iron Works Catalog, 1974–75, front and rear covers and pp. 4918–4955, in particular, pp. 4947 for "TIW Cementing Manifolds", 40 pps.

Texas Iron Works Catalog, 1976–77, front cover and pp. 5544, 2 pps.

Texas Iron Works Catalog, 1982–83, front and rear covers and pp. 7910–7951, in particular, pp. 7922 for "TIW Cementing Equipment", 44 pps.

Texas Iron Works Catalog, 1986–87, front and rear covers and pp. 6090–6152, in particular, pp. 6106 for "Cementing Equipment", 64 pps.

TIW Liner Equipment Mechanical–Set Liner Hangers Specifications, pp. 12 or 2838 (prior art), 1 pp. (undated).

TIW Marketing Application Drawing, 1724.01 Mech EJ–IB–TC RHJ Liner Hanger, Pin–up Class (prior art), 1 pp., Mar. 21, 1997.

Davis Manual–Fill Float Shoes, pp. 868–870 (prior art), 3 pps. (undated).

Davis Self–Filling Float Shoes and Float Collars, pp. 872–873, (prior art), 2 pps. (undated).

Ray OIl Tool Company Introduces, Another Successful Tool: Intercasing Centralizers (Inline Centralizers), Lafayette, Louisiana (prior art), 7 pps. (undated).

TIW, Liner Equipment, Hydro–Hanger specifications pp. 2837 and 1718.02 IB–TC R HYD HGR W/PIN TOP (prior art), 2 pps. Mar. 21, 1997.

Weatherford Gemoco, ©Weatherford 1993, Model 1390 and 1490 Float Shoe Sure Seal Auto Fill, May 10, 1994, 8 pps. Note patent pending on last page.

TIW Corporation, Marketing application Drawing, 0758.05 Circulating Sub (prior art), 1 pp. (1997).

Downhole Products, The Spir–O–Lizer™ (Patented), (Represented in North America by Turbeco Inc., 7030 Empire Central Drive, Houston, Texas 77040) (prior art), 7 pps. (Dec. 28, 1995).

SPE Drilling & Completion, Dec. 1996, Copyright 1996 Society of Petroleum Engineers, Zonal Isolation and Evaluation for Cemented Horizontal Liners, pp. 214–220; Turbeco, Inc. Spir–O–Lizer Products Job Log, 2 pps.; Downhole Products PLC Spir–O–Lizer Products Job Log, 8 pp. front and back; Spir–O–Lizer Technical Information and Price List, 1 pp.

Halliburton Services, RTTS Circulating Valve, 3 pps; RTTS Equipment, Operating Procedure (prior art), 2 pps. (undated).

TIW Liner Equipment, Setshoes, Type LA Setshoe; Type LA–2 Setshoe; Type CLS–2 Setshoe; and Type CB–2 Setshoe, pp. 23, (prior art), 1 pp. (undated).
TIW Corporation, Marketing application Drawing, 1904.01 Fillup Setshoe (prior art), 1 pp. (Mar. 21, 1997).
TIW Liner Equipment, Liner Float Equipment, C–LF Lading Collar; Regular Landing Collar; HS–SR Landing Collar with Ball–and–Seat Shear Assembly; and C Float Collar, pp. 22 (prior art), 1 pp. (undated).
TIW Corporation, Marketing application Drawing, 1816.01 PDC L Landing Collar w/ Anti–Rotation Clutch (prior art), 1 pp. (Mar. 21, 1997).
Davis Cementing Enhancement Devices, Davis Non–Welded Semi–Rigid Centralizer (SRC); Davis Non–Welded Rigid Centralizer; and Centralizer Comparison Chart, p. 886 (prior art), 1 pp. (undated).
Varco, B.J. Drilling System Reference Drawing Sheets, TDS–6S Block Dolly; TDS–6S Guide Dolly; and Crank Assy Installation (prior art), 6 pps. (undated).
A Model "E" "Hydro–Trip Pressure Sub" No. 799–28, distributed by Baker Oiul Tool, a Baker Hughes Company of Houston, Texas, is installable on a string below a hydraulically actuated tool, such as a hydrostatic packer to provide a method of applying the tubing pressure required to actuate the tool. To set a hydrostatic packer, a ball is circulated through the tubing and packer to the seat in the "Hydro–Trip Pressure Sub", and sufficient tubing pressure is applied to actuate the setting mechanism in the packer. After the packer is set, a pressure increase to approximately 2,500 psi (17, 23MPa) shears screws to allow the ball seat to move down until fingers snap back into a groove. The sub then has a full opening, and the ball passes on down the tubing, as discussed in the Background of the Invention of the present application. (See "CI" above) (undated).
No. 0758.05 sliding sleeve circulating sub or fluid bypass manufactured by TIW Corporation of Houston, Texas (713)729–2110 used in combination with an open (no float) guide shoe, as discussed in the Background of the Invention of the present application. (See "DJ" above) (undated).
Halliburton RTTS circulating valve, distributed by Halliburton Services. The RTTS circulating valve touches on the bottom to be moved to the closed port position, i.e. the J–slot sleeve needs to have weight relieved to allow the lug mandrel to move. The maximum casing liner weight that is permitted to be run below the Halliburton RTTS bypass is a function of the total yield strength of all the lugs in the RTTS bypass which are believed to be significantly less than the rating of the drill string, as discussed in the Background of the Invention of the present application. (See "DN" above) (undated).
A Primer of Oilwell Drilling by Ron Baker, Published by Petroleum Extension Service, The University of Texas at Austin, Austin, Texas in cooperation with International Association of Drilling Contractors, Houston, Texas 1979, cover page and pp. 56–64, 10 pps.
Schlumberger Dowell Brochure—Don't let cementing in deepwater put your well at risk, 5 pps. (1997).
Connect Schlumberger Homepage, connect Schlumberger Log–in, Jul. 23, 1997, 2 pps. Schlumberger Limited, Welcome to Schlumberger, 2 pps. Search the Schlumberger Server, 1 pp. Excite for Web Servers Search Results, Jul. 23, 1997, 4 pps. Excite for Web Servers Search Results, Jul. 24, 1997, 4 pps.
"DeepSea Expres*"—Dowell developed the Expres concept of preloading casing wiper plugs inside a basket several years ago. Expanding this approach to subsea cementing greatly simplifies plug design. By also utilizing three darts and three plugs rather than a ball, a system had been devised that provides: Enhanced reliability, Improved jog quality, Reduced rig time Jul. 23, 1997, 1 pp.
DeepSea Expres—Surface Dart Launcher (SDL), Jul. 23, 1997, 2 pps.
DeepSea Expres—SubSea Tool (SST), Jul. 24, 1997, 2 pps.
SCR Patents 1987–1996—Schlumberger Cambridge Research by Author, Jul. 24, 1997, 8 pps.

* cited by examiner

SYSTEM FOR RUNNING TUBULAR MEMBERS

BACKGROUND OF THE INVENTION

1. Field of the Invention

The present invention relates to an apparatus for running tubular members such subsea casing strings in a wellbore. More particularly the present invention relates to a wiper plug and internal drop ball mechanism that may be used in conjunction with the running and cementing of such tubular members in a wellbore.

2. Description of the Prior Art

In oilfield applications, a "casing liner" and a "subsea casing string" are tubular members which are run on drill pipe. The term "casing liner" is usually used with respect to drilling operations on land, while the term "subsea casing string" is used with respect to offshore drilling operations. For ease of reference in this specification, the term "casing liner" is used to denote either a "casing liner" or "subsea casing string."

Prior art drop ball-actuated float equipment for use in cementing casing liners in place includes, for example, a float shoe or float collar which has one or more flapper valves and which is located at or near the bottom of the casing liner. The flapper valve or valves are conventionally held open by a breakable plastic tab which is actuated (i.e., broken) by a drop ball when the cementing operation is to begin. The industry has traditionally used systems where a drop ball is released at the surface, and the drop ball must be small enough in diameter to pass through the smallest restriction in the drill string, which usually is the diameter of the bore in the running tool. The size of such restrictions has, therefore, limited the maximum size of the opening in a float collar or shoe. In the case of 13⅜" casing liner, the maximum diameter of a drop ball is somewhere between 2 to 3 inches. Due to the small diameter bore of traditional float equipment and the highly contaminated environment in which such equipment is used, the valves in traditional float equipment tend to become plugged with cuttings and contaminants.

As a casing liner is lowered into the wellbore, the fluid in front of the casing liner must be displaced to flow through the opening in the float equipment as well as around the outside annulus defined by the wellbore and the casing liner. The flow resistance of the two flow paths may be high and thus causes a pressure known as surge pressure to build up below the casing liner. This surge pressure can: (a) cause damage to the formation; (b) result in loss of expensive drilling fluid; and (c) result in the casing liner sticking against the side of the borehole, which means the casing liner does not go to the bottom of the hole.

U.S. Pat. No. 5,960,881, which is incorporated herein by reference, discloses a downhole surge pressure reduction system to reduce the pressure buildup while running in a tubular member such as a casing liner. The system is typically located immediately above the top of the casing liner. Nonetheless, any plugging of the float equipment at the lower end of the subsea casing string can, and very well may, render the surge pressure reduction system of the '881 patent ineffective.

The method and apparatus according to the present invention overcomes the plugging problem and allows enhanced passage of fluid through the tubular member and into the surge pressure reduction tool.

SUMMARY OF THE INVENTION

In accordance with the present invention, apparatus is provided for running a tubular member through a wellbore containing drilling fluid using a drill string.

Apparatus in accordance with the present invention comprises a running tool connected to the top of the tubular member having an axial bore therethrough.

Apparatus in accordance with the present invention further comprises a wiper plug assembly which is releasably suspended from a running tool for the wiper plug within the tubular member and having a receptacle sleeve to receive a drill pipe dart. During cementing operations, the wiper plug assembly receives the drill pipe dart and is released from the drill string at the top of the tubular member. The wiper plug assembly is then pumped downward forcing cement out of the bottom of the tubular member and into the annulus between the tubular member and the borehole.

One end of the running tool for the wiper plug is connected to the running tool attached to the tubular member. The running tool for the wiper plug comprises an axially indexing sleeve and a plurality of wedge-shaped fingers which releasably engage the wiper plug receptacle sleeve. During running in of the tubular member, the drilling fluid flows from the casing liner upward through the ports between the fingers and into the void above the wiper plug fins. To isolate the wiper plug fins from internal pressure during cementing operations, the drill pipe sleeve is indexed axially downward to block the ports between the fingers.

Apparatus in accordance with the present invention also comprises a drop ball sub attached to and below the wiper plug assembly within the tubular member. The drop ball sub releases a float equipment actuator ball which is larger in diameter than the smallest restriction in the drill string. When released, the actuator ball drops to the bottom of the tubular member where it actuates float equipment. Once actuated, flapper valves in the float equipment prevent the back flow of cement traveling downward through the tubular member.

Apparatus in accordance with the present invention may further comprise a surge pressure reduction device or diverter tool connected between the drill string and the running tool. When the diverter tool is in an open port position, the drilling fluid may flow upward from inside the diverter tool into the annulus between the casing cemented in place and the drill string. When in a closed port position, the device provides passage for fluid to travel downward through the drill string.

DESCRIPTION OF SPECIFIC EMBODIMENTS OF THE INVENTION

A description of certain embodiments of the present invention is provided to facilitate an understanding of the invention. This description is intended to be illustrative and not limiting of the present invention. In the appended claims, the term "tubular member" is intended to embrace either a "casing liner" or a "subsea casing string."

Figure 1:
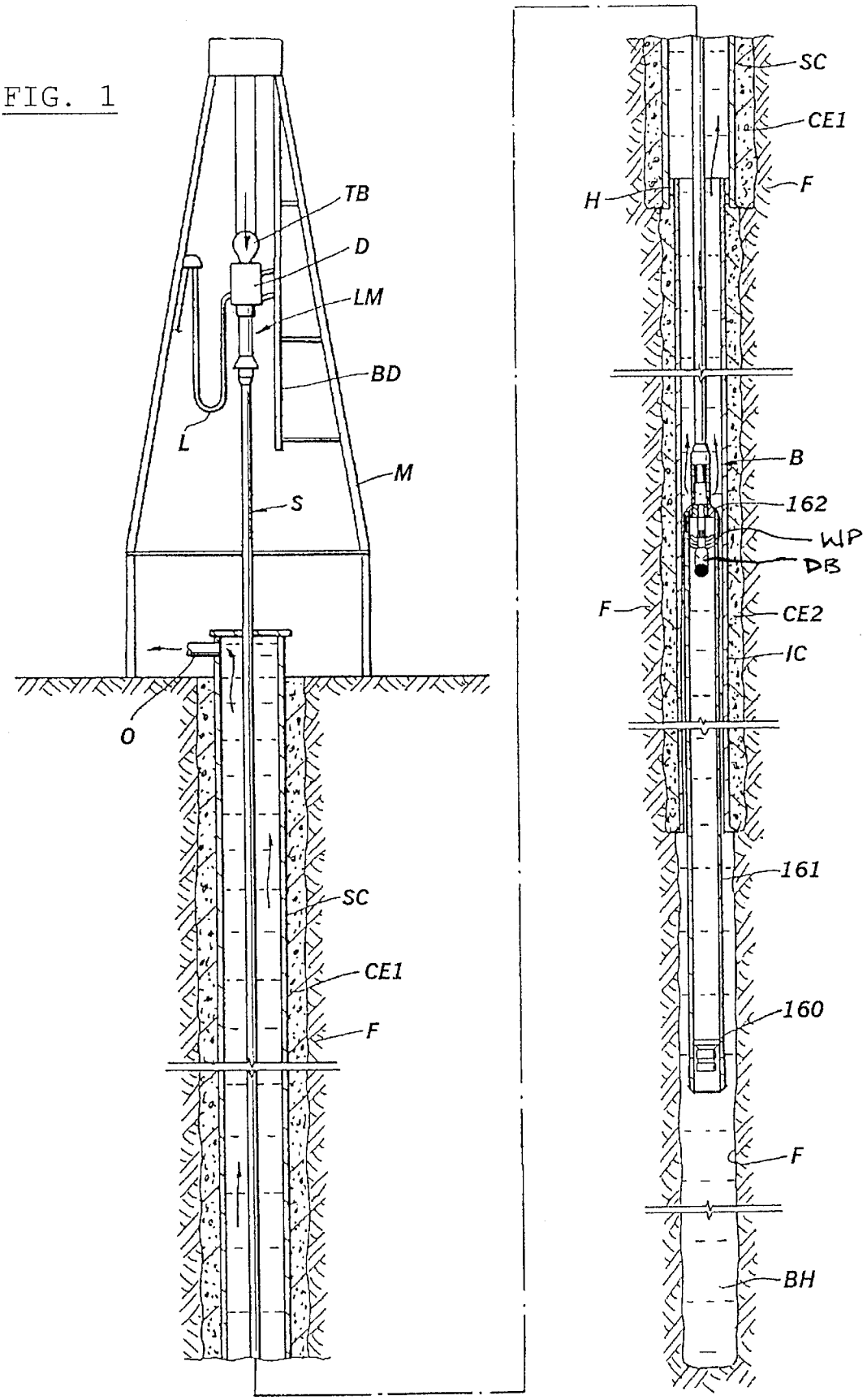
FIG. 1 is an elevation view of an embodiment of the system of the present invention for running of a tubular member downhole.

With reference first to FIG. 1, the general components of a system are illustrated in which apparatus in accordance with the present invention is used. A mast M suspends a traveling block TB. The traveling block, in turn, supports a top drive TD which moves vertically on a block dolly BD. An influent drilling fluid line L supplies the top drive TD with drilling fluid from a drilling fluid reservoir (not shown). A launching manifold LM connects to a drill string S. The drill string S comprises numerous pipes which extend down into the borehole BH, and the number of such pipes is dependent on the depth of the borehole BH. A flow diverting device B is connected between the bottom end of drill string S and the top of running tool 162. A casing liner 161 is suspended from running tool 162. Float equipment, e.g. float collar 160, is fastened near the bottom of the casing liner 161.

Solidified cement CE1 fixes a surface casing SC to the surrounding formation F. The surface casing SC contains an opening O in the uppermost region of the casing adjacent to the top. The opening O controls return of drilling fluid as it travels up the annulus between the drill string S and the surface casing SC.

Solidified cement CE2 fixes an intermediate casing IC to the surrounding formation F. The intermediate casing IC is hung from the downhole end of the surface casing SC by a mechanical or hydraulic hanger H.

The annulus between the drill string S and the intermediate casing IC is greater in area than the annulus between the casing liner 161 and the intermediate casing IC. While the present invention is not intended to be limited to use in tight or close clearance casing runs, the benefits of the present invention are more pronounced in tight clearance running, since as the area is reduced and the pressure (pressure is equal to weight/area) is increased.

Figure 2:
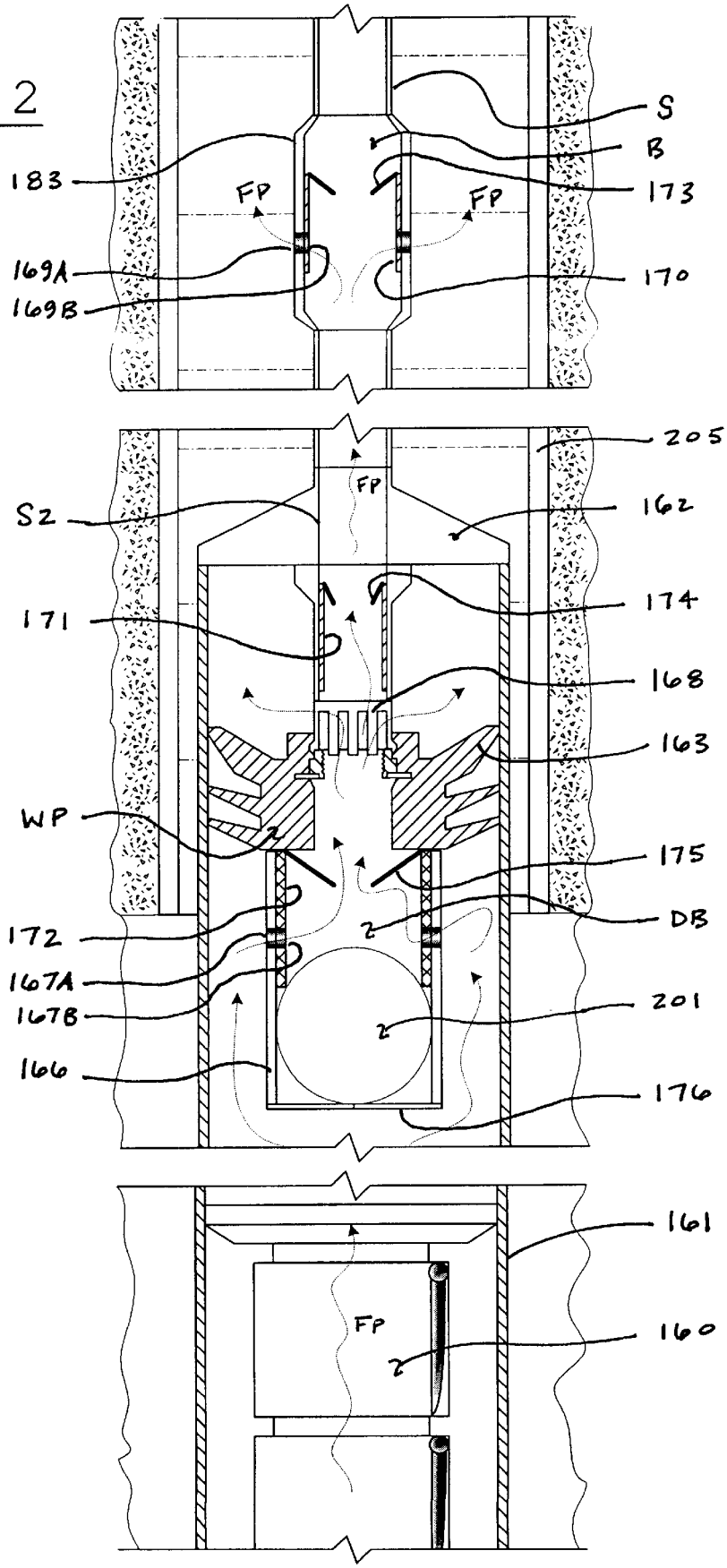
FIG. 2 is an elevation view of an embodiment of the present invention illustrating flow path of the drilling fluid facilitating surge pressure reduction as tubular member is run downhole.

Referring now to FIG. 2, apparatus in accordance with the present invention comprises running tool 162 which is connected to the top of casing liner 161 and which has an axial bore therethrough. In one embodiment of the present invention, a flow diverter tool B is removably connected between drill string S and running tool 162, and in another embodiment of the present invention, no such diverter tool is employed. Diverter tool B, when used, is preferably a diverter device as disclosed in the '881 patent. The diverter tool device B comprises a housing 183 having at least one housing flow port 169A, a yieldable seat 173, and a sleeve 170 having at least one sleeve flow port 169B. When diverter tool B in the "open port position," sleeve 170 is arranged such that housing flow port 169A and sleeve flow port 169B are aligned. This provides passage for drilling fluid to flow from inside of housing 183 to annulus between drill string S and the cemented in place casing 205. When the diverter tool B is in the "closed port position," sleeve 170 has been indexed axially downward so that housing flow port 169A and sleeve flow port 169B are not axially aligned and the flow passage is blocked.

Wiper plug assembly WP is suspended inside casing liner 161 from running tool 162 by the running tool S2 for the wiper plug, one end of which is connected to running tool 162. The wiper plug WP is releasably connected to the second end of the running tool S2 by collet fingers 168. The openings or ports between collet fingers 168 provide communication to the void above wiper plug fins 163. Drilling fluid flowing upward from drop ball sub 166 to flow diverter device B passes through the ports between collet fingers 168 and fills the void above wiper plug fins 163. When casing liner 161 has been lowered to full depth, sleeve 171 may be indexed axially downward to block flow through the ports between collet fingers 168, thereby isolating the wiper plug fins 163 from internal pressure.

Drop ball assembly DB is attached to the bottom of wiper plug assembly WP. The drop ball assembly DB comprises a housing 166 having at least one housing flow port 167A, a yieldable seat 175, a sleeve having at least one sleeve flow port 167B, an actuator ball 201, and a second yieldable seat 176. Before the release of actuator ball 201, sleeve 172 is arranged in the "open port position" such that housing flow port 167A and sleeve flow port 167B are aligned. These aligned ports provide a passage for drilling fluid to flow as discussed below.

Float equipment 160, which may for example be a float collar, is located at or near the bottom of casing liner 161 and contains flapper valves which are actuated by the release of actuator ball 201. The diameter of actuator ball 201 is greater than the smallest diameter in the drill string and corresponds to the diameter of the float equipment. Preferably, the float equipment utilized is the multi-purpose float collar which is available from Davis-Lynch, Inc. of Houston, Tex.

Still referring to FIG. 2, in operation, apparatus in accordance with one embodiment of the present invention is intended to be run down a borehole through drilling fluid while in the open port position. In the "open port position," sleeve 170 of flow diverter device B (when used), sleeve 171 of wiper plug assembly WP, and sleeve 172 of drop ball sub DB being positioned such that drilling fluid may follow flow path FP upward through the bore of float equipment 160. Following the flow path, drilling fluid then flows into the housing of drop ball sub DB above actuator ball 201 via aligned housing flow port 167A and sleeve flow port 167B, and through the bore in the wiper plug. Drilling fluid then fills the void above the wiper plug fins 163 via the openings between collet fingers 168. The drilling fluid then flows through drill string S2 and running tool 162, into diverter device B, and finally out of diverter device B into the annulus between drill string S and the cemented-in-place casing 205 via aligned flow hole 169A and flow port 169B. The benefits of surge pressure reduction are thus provided.

In the embodiment of the present invention where no diverter tool is utilized, drilling fluid flows through drill string S2 and running tool 162 and through drill string S.

Figure 3:
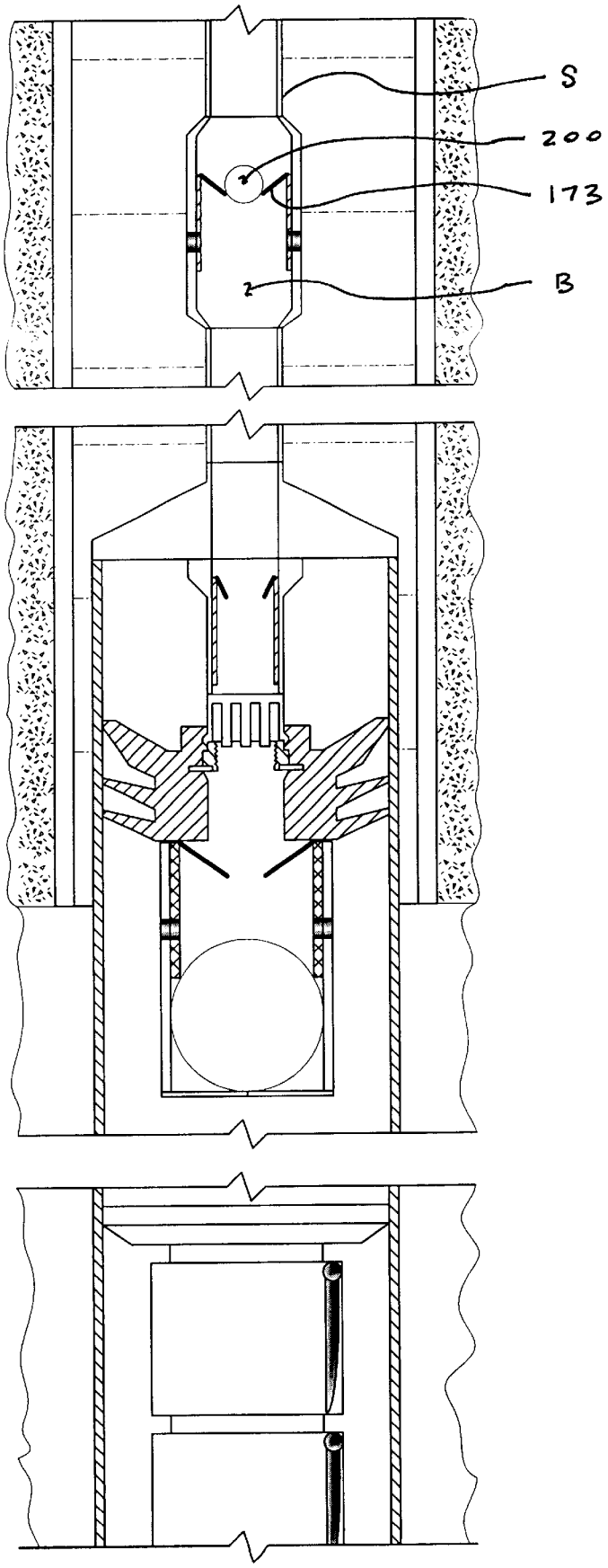
FIG. 3 is an elevation view of an embodiment of the present invention illustrating a drop ball seated in a yieldable seat of surge reduction apparatus with the ports of that apparatus in open position.

Referring to FIG. 3, once the casing liner has been lowered to full depth and cementing operations are ready to begin, a drop ball 200 is dropped down drill string S and into yieldable seat 173 of flow diverter device B. If a diverter tool is not used, the first landing point for drop ball 200 is yieldable seat 174. The diameter of drop ball 200 is less than the smallest diameter of any restriction in drill string S. For example, a 2¼ inch diameter drop ball may be used for a drill string with inside diameter of 3 inches.

Figure 4:
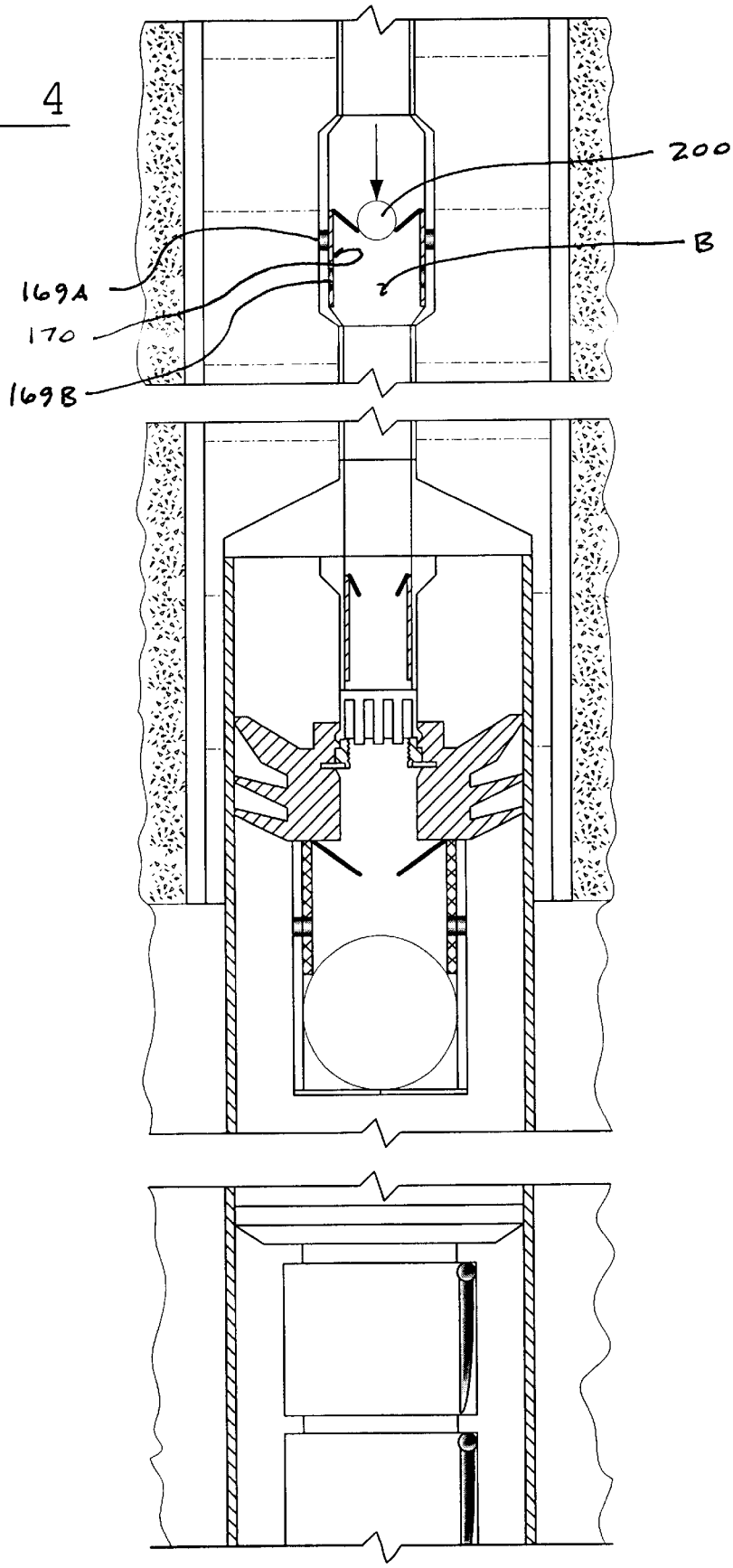
FIG. 4 is an elevation view of an embodiment of the present invention illustrating the surge reduction apparatus of FIG. 3 with the ports of that apparatus in closed position.

Referring now to FIG. 4, drilling fluid is pressurized to a predetermined level above drop ball 200 such that sleeve 170 is moved axially downward blocking housing flow holes 169A. The flow diverter device B is now in the "closed port position."

Figure 5:
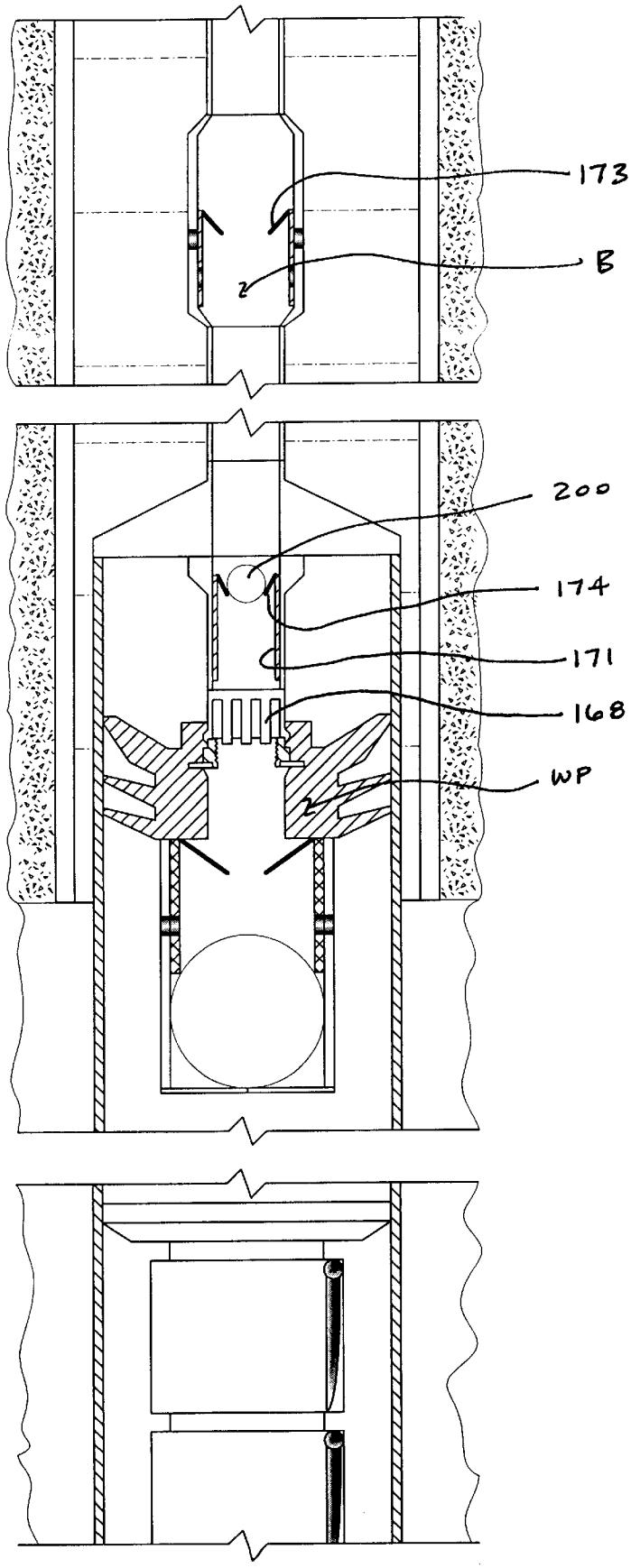
FIG. 5 is an elevation view of an embodiment of the present invention illustrating second drop ball seated in yieldable seat of a collet finger sleeve with the ports in open position.
Figure 6:
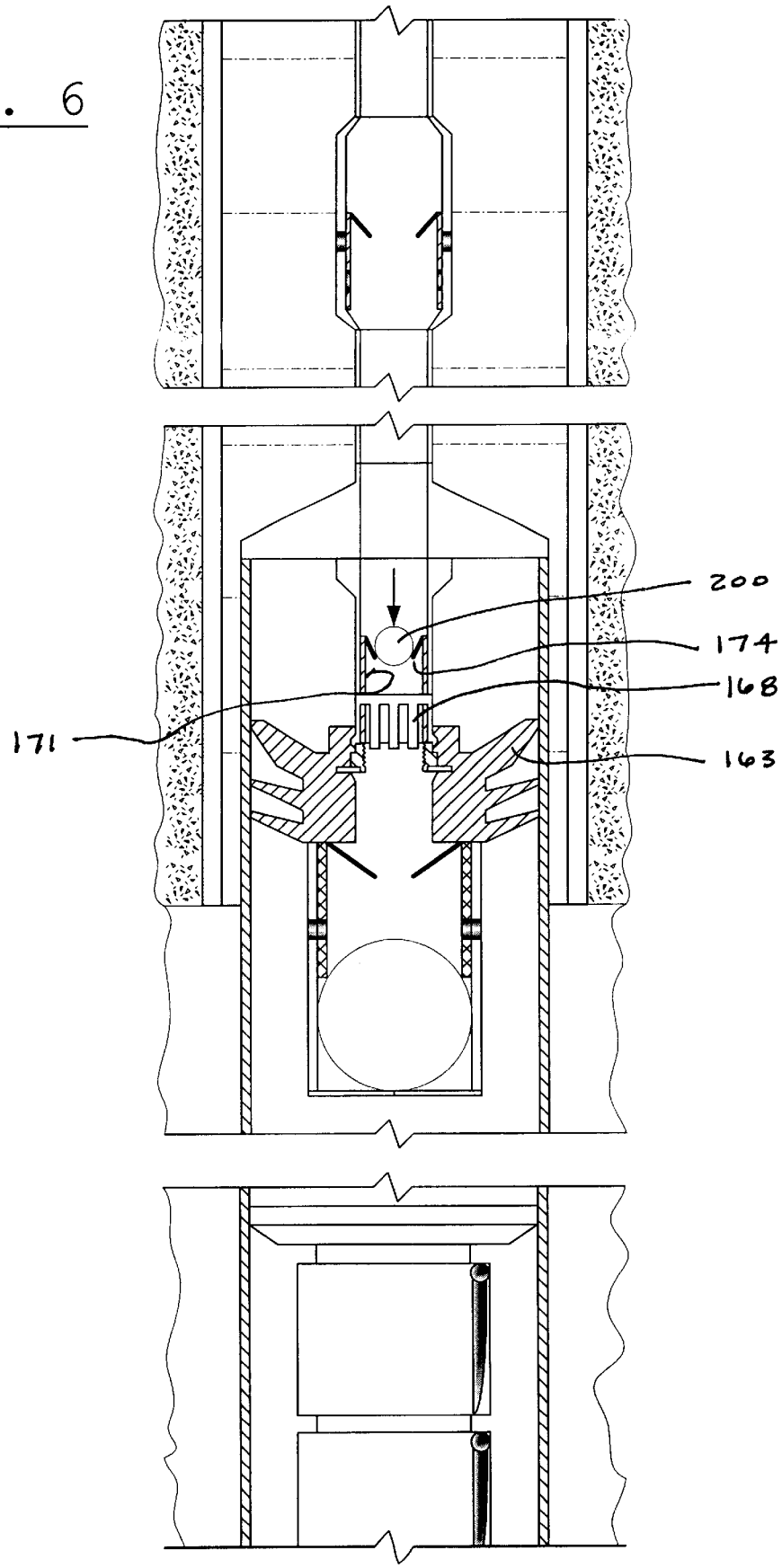
FIG. 6 is an elevation view of an embodiment of the present invention illustrating the collet finger sleeve blocking the collet finger ports.

Referring to FIG. 5, drilling fluid above drop ball 200 is further pressurized to a such expanded yieldable seat 173 expands, and drop ball 200 passes through yieldable seat 173 and lands in yieldable seat 174 of collet finger sleeve 171. Drilling fluid is then pressurized above drop ball 200 such that sleeve 171 is moved axially downward which closes the ports formed by the spaces between collet fingers 168 as illustrated in FIG. 6.

Figure 7:
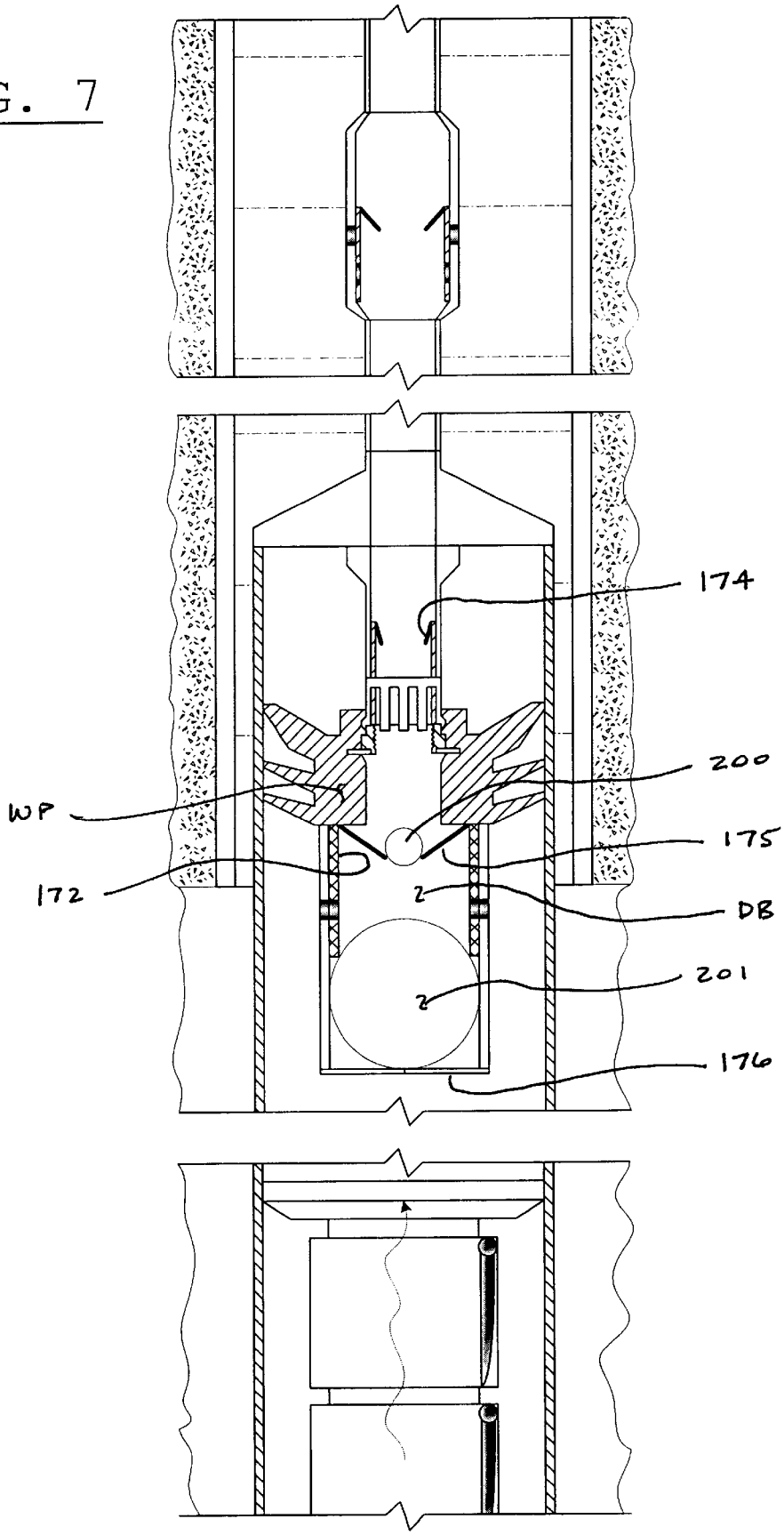
FIG. 7 is an elevation view of an embodiment of the present invention illustrating the drop ball seated in yieldable seat of a drop ball sub apparatus with the port of that apparatus in open position.
Figure 8:
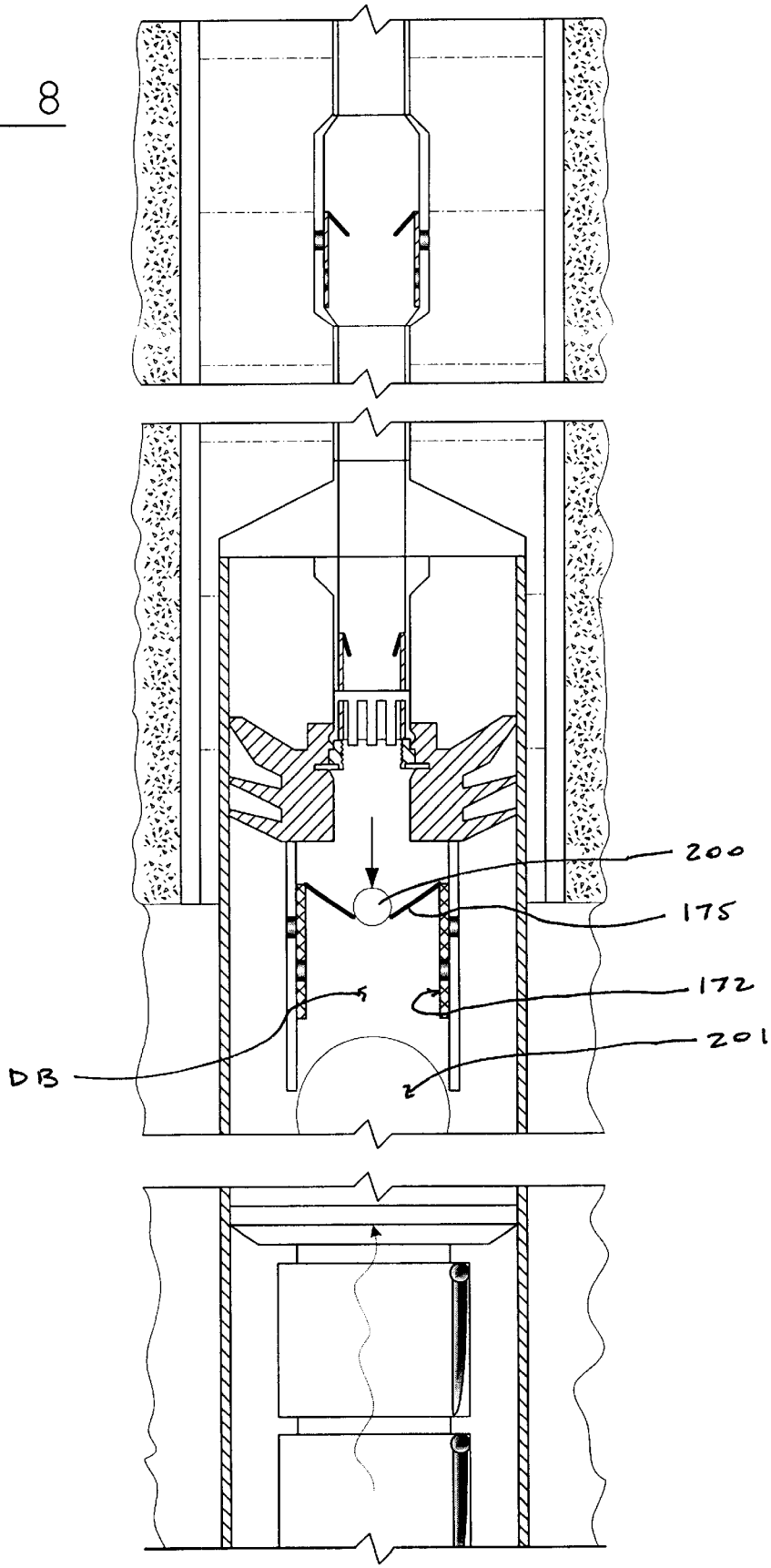
FIG. 8 is an elevation view of an embodiment of the present invention illustrating a flapper valve actuator ball being forced through a yieldable seat and drop ball sub apparatus with ports in closed position.

Referring to FIG. 7, drilling fluid above drop ball 200 is further pressurized such the yieldable seat 174 expands and drop ball 200 passes through expanded yieldable seat 174 and lands in seat 175 of drop ball sub 176. Drilling fluid is then pressurized to a predetermined level above drop ball 200 such that sleeve 172 is moved axially downward. As sleeve 172 moves downward, the sleeve engages float valve actuator ball 201 and forces the ball through yieldable seat 176 as illustrated in FIG. 8.

Figure 9:
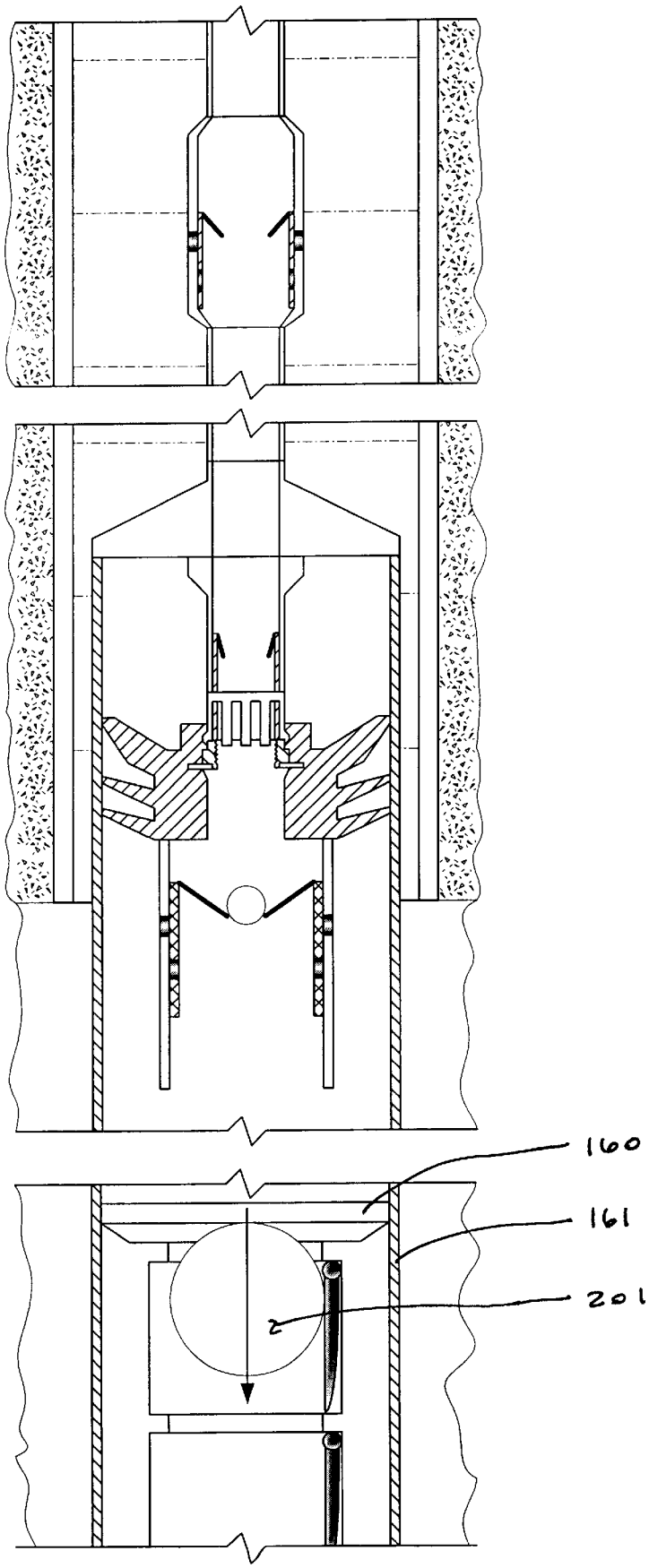
FIG. 9 is an elevation view of an embodiment of the present invention illustrating the flapper valve actuator ball engaging a float collar.

With reference to FIG. 9, the float valve actuator ball 201 is released from drop ball sub 166 and moves downward toward the bottom of casing liner 161 where ball actuates flapper valves of float equipment 160. Float valve actuator ball 201 then continues to bottom of casing liner 161 and exits casing liner 161 where it may subsequently be grinded into filings by downhole drill equipment.

Figure 10:
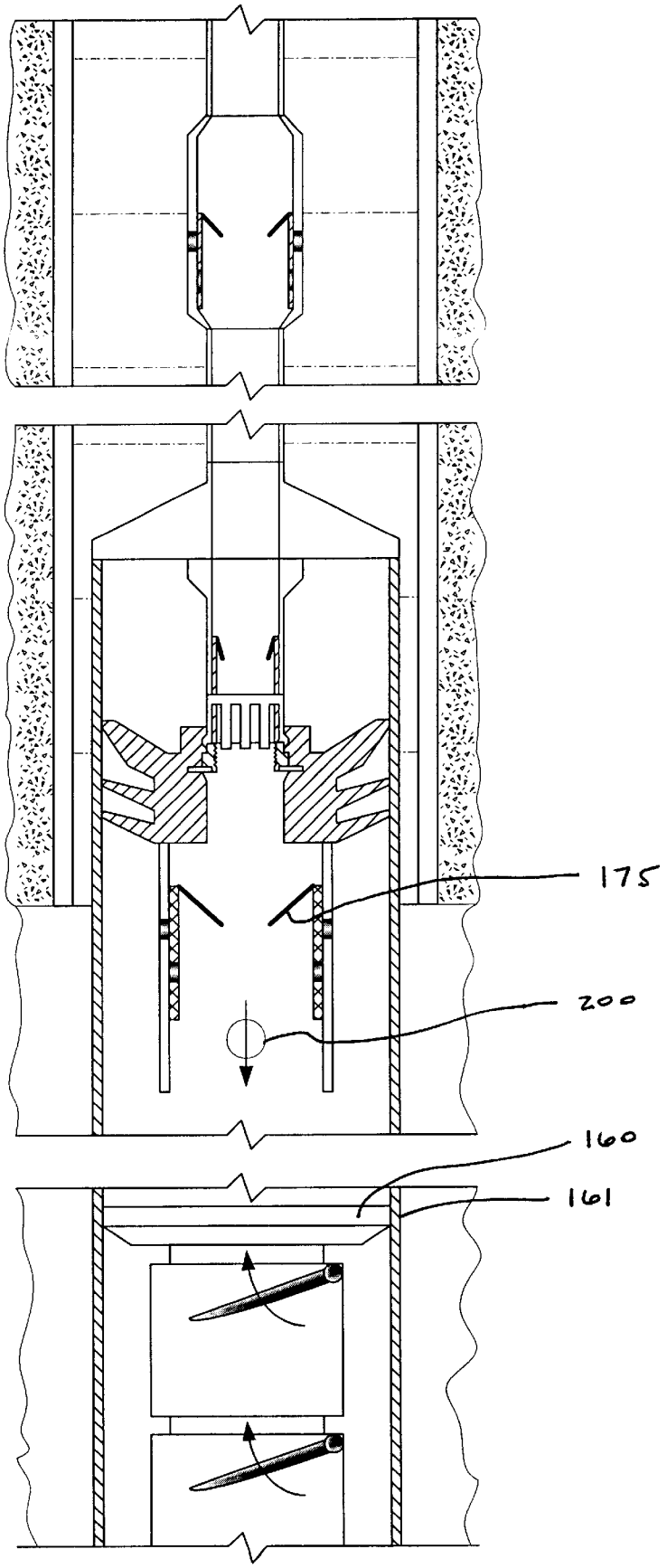
FIG. 10 is an elevation view of an embodiment of the present invention illustrating a drop ball being pressured through yieldable seat in the drop ball sub apparatus.

With reference to FIG. 10, drilling fluid above drop ball 200 is further pressurized such that yieldable seat 175 is expanded and drop ball 200 passes through the expanded seat 175, and exits casing liner where it may subsequently be grinded into filings by downhole drill equipment. At this time, the cementing operations are ready to commence.

Figure 11:
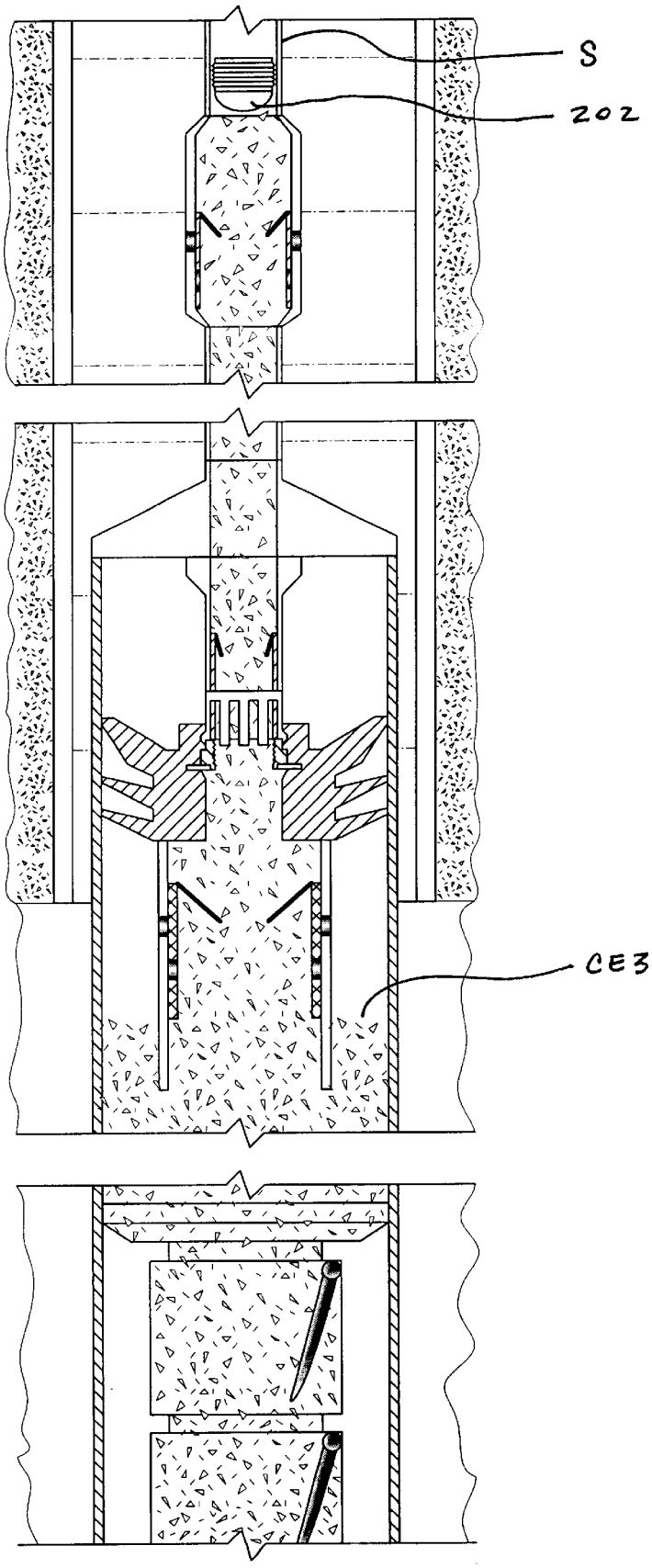
FIG. 11 is an elevation view of an embodiment of the present invention illustrating a dart being pumped downhole behind cement.
Figure 12:
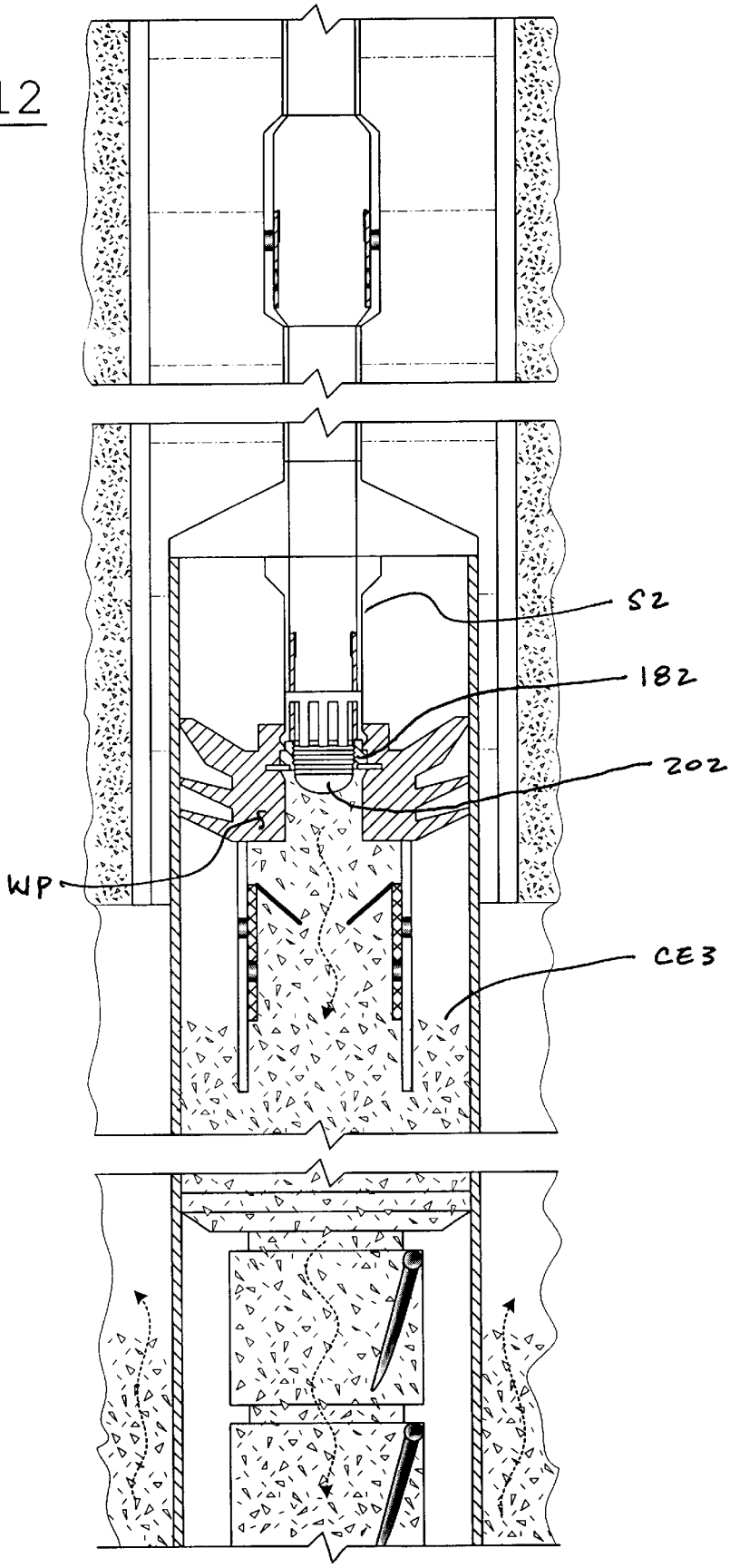
FIG. 12 is an elevation view of an embodiment of the present invention illustrating the dart of FIG. 11 being pumped downward through drill string and engaging a seat in a wiper plug assembly.
Figure 14A:
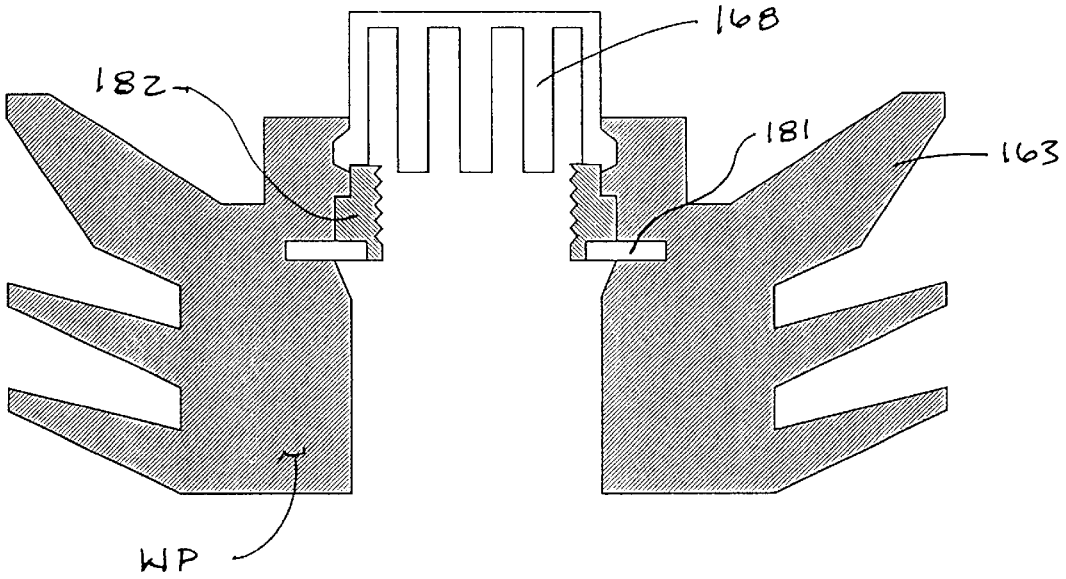
FIG. 14A is an enlarged section view of the wiper plug assembly with collet fingers engaging wiper plug upper flange.

With reference to FIG. 11, once cement pumping is complete, a drill pipe dart 202 is inserted into top of drill string S and displaced downward by drilling fluid so that dart 202 establishes a barrier between drilling fluid and cement CE3. With reference to FIGS. 12 and 14A, once the dart 202 reaches wiper plug assembly WP, the dart engages a receptacle sleeve 182. The dart 202 conventionally comprises a nose section with a barbed "shark tooth" profile "c-ring" for connection with receptacle sleeve 182 and elastomer o-ring seals. The receptacle sleeve 182 comprises a mating tooth profile for connection with the dart 202 and a seal bore for receiving the o-rings. In this way, the dart 202 and receptacle sleeve 182 form a sealed mechanical connection.

Figure 13:
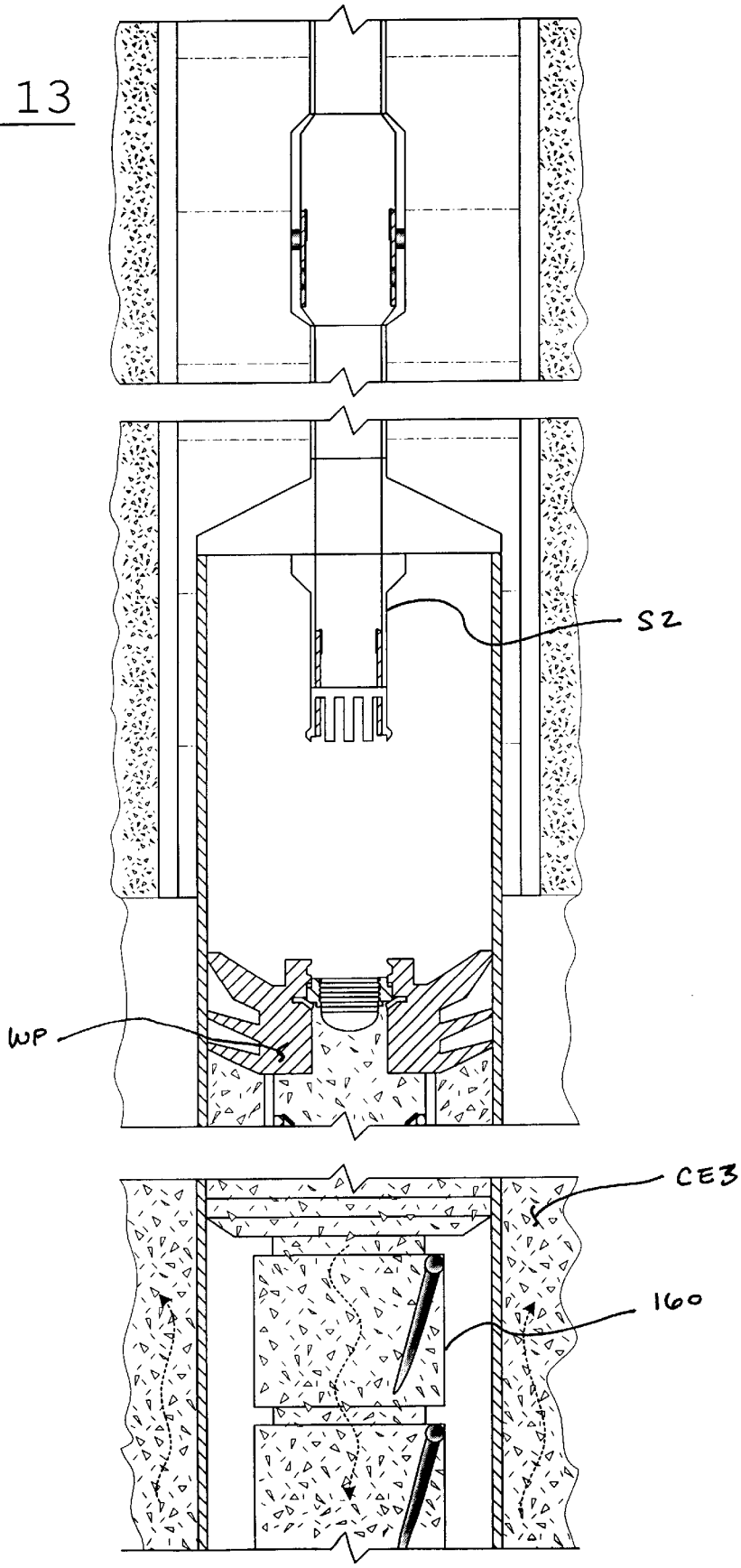
FIG. 13 is an elevation view of an embodiment of the present invention illustrating a wiper plug assembly being wound downward through a tubular member and forcing cement downward through float equipment, out of casing liner, and upwards into annulus between casing liner and formation.
Figure 14B:
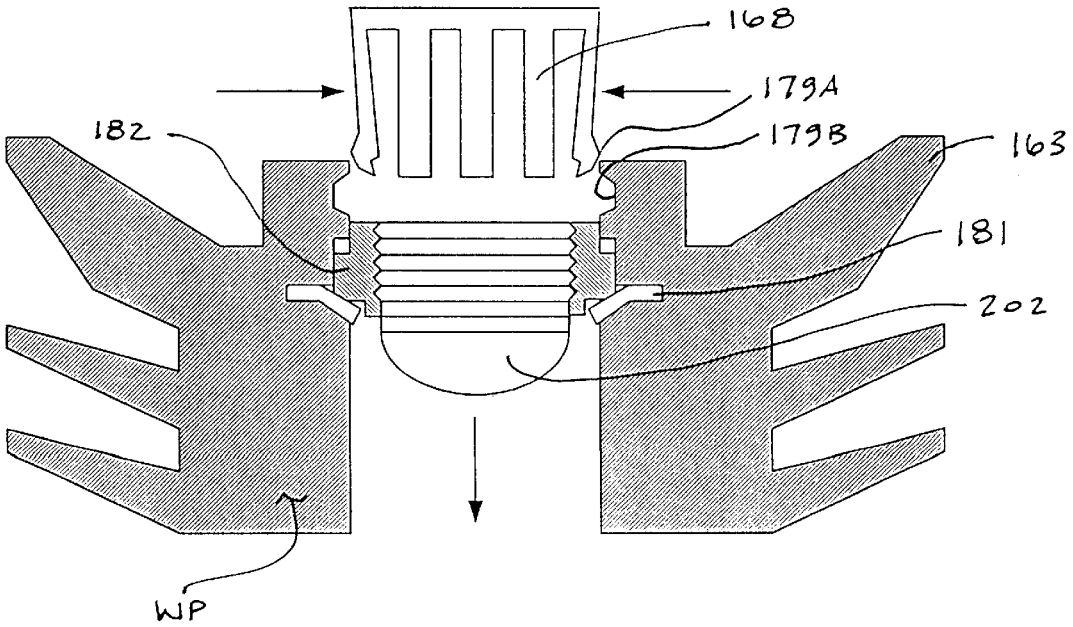
FIG. 14B is an enlarged section view of the dart engaging wiper plug assembly with collet fingers moving radially inward and releasing wiper plug.

With reference to FIGS. 13 and 14B, a yieldable, disk-shaped flat washer 181 supports dart receptacle sleeve 182 in the wiper plug assembly WP. Flat washer 181 is mounted in such a way that force imparted by dart 202 is carried through the washer 181. As drilling fluid is further pressured above dart 202, the flat washer 181 yields and deflects slightly downward. The deflection of the flat washer 181allows the receptacle sleeve 182 to move slightly downward. The dart receptacle sleeve 182 serves as a backup to collet fingers 168 formed on the end of the drill string S2. The collet fingers 168 are formed such that their lower outer ends comprise wedge surfaces 179A, which are captured in a mating recess 179B in the top flange portion of the wiper plug assembly WP. As the dart receptacle sleeve 182 displaces downward due to the pressure above the dart 202, the radial support for the collet fingers 168 is lost. The loss of radial support allows the wedge surfaces 179A to force the collet fingers 168 radially inward thereby releasing the wiper plug assembly WP from the drill string S2.

With reference still to FIG. 13, once released from drill string S2, the wiper plug WP may be pumped down the casing liner 161 thereby displacing cement CE3 in the casing liner down through the flapper valves of float equipment 60. The flapper valves of the float equipment 160 should prevent any "back-flow" or "u-tube action" of the cement.

Once the liner wiper plug WP has been pumped to the bottom of the casing liner, the cement is allowed to harden, thereby completing the hanging and cementing job.

What is claimed is:

1. Apparatus for running a tubular member in a wellbore containing drilling fluid using a drill string, comprising:

a running tool connected to the top of the tubular member and having an axial bore therethrough;

a wiper plug assembly releasably connected to the drill string within the tubular member near the top of the tubular member, said wiper plug assembly having a bore therethrough and said wiper plug including a receptacle in said bore for receiving a drill string dart;

a drop ball housing connected to the wiper plug assembly below the wiper plug assembly, said drop ball housing: (a) including a releasable drop ball having a diameter greater than the inside diameter of the drill string and (b) having ports above the drop ball through which drilling fluid may flow into the bore of the wiper plug; and float equipment attached to the tubular member near the bottom of the tubular member, said float equipment having an axial bore through which drilling fluid may flow, said axial bore having a diameter greater than the inside diameter of the drill string, said float equipment including a plurality of flapper valves which are activated by the drop ball after it is released from the drop ball housing.

2. The apparatus of claim 1, further comprising a diverter tool connected between the drill string and the running tool, said diverter tool having an open port position and a closed port position, said diverter tool being in the open port position during the running in of the tubular member.

3. The apparatus of claim 2, wherein the diverter tool comprises:

a housing connected to the drill string, said housing having a set of housing flow ports formed therein;

a sleeve within the housing having a set of sleeve flow ports formed therein; said sleeve being initially positioned within the housing such that an open port position exists;

a yieldable drop ball seat connected to the sleeve; and an axial indexing means to move the sleeve between open port position and closed port position.

4. The apparatus of claim 2, further comprising a wiper plug release mechanism for releasing the wiper plug from the drill string, said release mechanism comprising:

a plurality of fingers which are formed on the end of the drill string such that an opening exists between each adjacent finger, said fingers having lower outer ends that have wedge-shaped surfaces for engagement with the dart receptacle of the wiper plug; and a yieldable, circular flat washer in the wiper plug which supports the receptacle and which allows the fingers to disengage from the receptacle when the dart is received and when pressure is increased behind the dart.

5. The apparatus of claim 2, wherein the drill string comprises:

a plurality of fingers which engage the wiper plug assembly and which have a port between adjacent fingers;

a sleeve within the drill pipe which is initially in the open position to allow drilling fluid to flow between the tubular member and the void immediately above the wiper plug via ports between the drill string fingers, said sleeve being movable to a closed position blocking the ports between the drill string fingers; and a yieldable drop ball seat connected to the sleeve.

6. The apparatus of claim 2, wherein the drop ball housing comprises a first yieldable seat on which the drop ball is installed, a release sleeve within the housing which, when activated, forces the drop ball out of the housing through the first yieldable seat, and a second yieldable seat connected to the release sleeve for receiving a ball which is dropped down the drill string.

7. The apparatus of claim 2, wherein the open port position of the diverter tool comprises a flow path for drilling fluid to flow upward from the wellbore into the tubular member and through the wiper plug assembly, from the tubular member to the diverter tool, and from the diverter tool into an annular space between the drill string and the wellbore.

8. The apparatus of claim 7, wherein the closed port position of the diverter tool comprises an alternative flow path for drilling fluid to flow downward from a drilling rig to the drill string, from the drill string to the running tool, from the running tool to the diverter tool, from the diverter tool to the tubular member and through the wiper plug assembly, and from the tubular member into the wellbore.

9. The apparatus of claim 1, further comprising a wiper plug release mechanism for releasing the wiper plug from the drill string, said release mechanism comprising:

a plurality of fingers which are formed on the end of the drill string such that an opening exists between each adjacent finger, said fingers having lower outer ends that have wedge-shaped surfaces for engagement with the dart receptacle of the wiper plug; and a yieldable, circular flat washer in the wiper plug which supports the receptacle and which allows the fingers to disengage from the receptacle when the dart is received and when pressure is increased behind the dart.

10. The apparatus of claim 1, wherein the drill string comprises:

a plurality of fingers which engage the wiper plug assembly and which have a port between adjacent fingers;

a sleeve within the drill pipe which is initially in the open position to allow drilling fluid to flow between the tubular member and the void immediately above the wiper plug via ports between the drill string fingers, said sleeve being movable to a closed position blocking the ports between the drill string fingers; and a yieldable drop ball seat connected to the sleeve.

11. The apparatus of claim 1, wherein the drop ball housing comprises a first yieldable seat on which the drop ball is installed, a release sleeve within the housing which, when activated, forces the drop ball out of the housing through the first yieldable seat, and a second yieldable seat connected to the release sleeve for receiving a ball which is dropped down the drill string.

* * * * *